US006662959B1

(12) United States Patent
Westerhold

(10) Patent No.: US 6,662,959 B1
(45) Date of Patent: Dec. 16, 2003

(54) WINE BOTTLE CONVERTIBLE TO WINE GLASS

(76) Inventor: John Westerhold, 13229-F Fiji Way, Marina Del Rey, CA (US) 90292

( * ) Notice: Subject to any disclaimer, the term of this patent is extended or adjusted under 35 U.S.C. 154(b) by 0 days.

(21) Appl. No.: 10/290,183

(22) Filed: Nov. 8, 2002

(51) Int. Cl.[7] ..... B65D 25/24

(52) U.S. Cl. ..... 215/378; 215/377; 220/23.86; 220/630

(58) Field of Search ..... 215/378, 377, 215/376; 220/23.86, 630

(56) References Cited

U.S. PATENT DOCUMENTS

| | | | |
|---|---|---|---|
| ,640,860 | A | 1/1900 | Baum, Jr. |
| 2,057,972 | A | 10/1936 | Pieck |
| 2,086,404 | A | 7/1937 | Daniels |
| 2,996,208 | A | 8/1961 | Schroeder |
| D199,461 | S | 10/1964 | Daily |
| 3,197,057 | A | 7/1965 | Weitzner |
| 3,391,849 | A | 7/1968 | Horning |
| D214,933 | S | 8/1969 | Swett et al. |
| 3,482,731 | A | 12/1969 | Douty |
| 3,526,335 | A | 9/1970 | Swett et al. |
| 3,724,709 | A | 4/1973 | Westphal |
| D251,950 | S | 5/1979 | McGowen |
| 4,289,248 | A | 9/1981 | Lynn |
| 4,591,066 | A | 5/1986 | Moen |
| 5,285,919 | A | 2/1994 | Recchia |
| 5,817,162 | A | 10/1998 | Penrith |
| D410,364 | S | 6/1999 | Ramirez |
| D419,868 | S | 2/2000 | DeVore |
| 6,164,473 | A | 12/2000 | Waldrip |
| 6,398,050 | B1 | 6/2002 | Allora |
| 2002/0104819 | A1 | 8/2002 | Matsui |

FOREIGN PATENT DOCUMENTS

| | | |
|---|---|---|
| FR | 2631936 | 12/1989 |
| GB | 1398595 | 6/1975 |

OTHER PUBLICATIONS www.fogdog.com/product/index.jsp?productld = 89570.

*Primary Examiner*—Joseph M. Moy
(74) *Attorney, Agent, or Firm*—Tom Hamill, Jr.

(57) ABSTRACT

A wine bottle convertible to a wine glass permitting the consumption of the wine directly therefrom is provided. The wine bottle may be sized to house a single serving of wine. The convertible wine bottle comprises four main elements which are assembled and filled with wine in a bottling process. The wine bottle has basically four integrated components with ancillary structure. These four components are assembled and filled with wine at a bottling plant. Once bottled, the convertible wine bottle may be packaged in 4-, 6-, or 8-packs, as well as individually. The wine bottles would then be transported and sold. These four integrated components are manipulated by the consumer to transform the wine bottle into a wine glass with an appropriate portion of wine therein. Such a convertible bottle of wine would give users the pleasure of drinking their wine from a stemmed glass. Once completed, the structure may be reassembled and recycled.

16 Claims, 11 Drawing Sheets

WINE BOTTLE CONVERTIBLE TO WINE GLASS

BACKGROUND OF THE INVENTION

1. Field of the Invention

The present invention is directed to the conversion of a wine bottle into a wine glass by the consumer.

2. Description of the Prior Art

Single serving wine bottles are known in the art. These are essentially smaller versions of standard 750 ml. wine bottles, and generally have a metal cap. Once purchased, the cap is removed and the contents are poured into a separate glass for consumption. In situations when a glass is not available, one could drink the wine directly from the bottle.

The instant invention overcomes this problem of requiring a separate glass to be employed with a single serving wine bottle by making the single serving wine bottle convertible into a wine glass. The instant invention is such that if all the wine is not consumed, a cap can be replaced on the bottle until it is so desired to be consumed. A wine bottle which converts easily into a wine glass would find utility in the airline industry, the alcoholic beverage industry, bars, hotels, clubs or anywhere wine is served. Such a device may also be employed with wine coolers or other alcoholic beverages. In addition, the novelty of a such a new and convertible device may be of interest to the bottling industry in general, where new ways to package beverages often increases their sales.

SUMMARY OF THE INVENTION

A wine bottle convertible to a wine glass permitting the consumption of the wine directly therefrom is provided. The wine bottle may be sized to house a single serving of wine. The convertible wine bottle comprises four main elements which are assembled and filled with wine in a bottling process. The wine bottle has basically four integrated components with ancillary structure. These four components are assembled and filled with wine at a bottling plant. Once bottled, the convertible wine bottle may be packaged in 4-, 6-, or 8-packs, as well as individually. The wine bottles would then be transported and sold. These four integrated components are manipulated by the consumer to transform the wine bottle into a wine glass with an appropriate portion of wine therein. Such a convertible bottle of wine would give users the pleasure of drinking their wine from a stemmed glass. Once completed, the structure may be reassembled and recycled.

The first element is the stem and base of the wine glass. The first element may be manufactured from plastic. The base includes a centrally disposed stem depending vertically therefrom. The base is designed to support the glass when the bottle is converted. The top portion of the stem may include a threaded socket or smooth socket. The base also is designed to be snap-fit or otherwise attached to the bottle prior to conversion to the wine glass.

The second element includes a generally cylindrical sidewall which has an interior side and an exterior side. The second element includes a centrally disposed parabolic portion which resides in the interior of the cylindrical sidewall. The interior cylinder sidewall includes threading to securely attach the second element to the third element. The parabolic portion forms a bowl on the exterior side and a displacement element on the interior side. The stem of the first element would reside within the bowl of the parabolic portion in the wine bottle configuration. The second element is manufactured from plastic or metal. It essentially forms a cap which is air and fluid tight with the third element forming a fluid reservoir which may be accessed through an aperture on the opposite side of the third element (the neck).

The third element has a generally cylindrical sidewall which also has an interior and an exterior side. The cylindrical sidewall tapers to a neck. Prior to tapering, on the exterior side of the cylindrical sidewall are threads. These threads securely engage with the second element's interior sidewall threading. The neck is the portion of the bottle to which a cap will be affixed. Thus, the external portion of the neck is threaded and designed to receive a cap thereon. It is proposed that the third element be manufactured from glass, plastic or other material.

The combination of the second element and the third element forms the reservoir which will be filled with wine. The interior side of the parabolic portion of the second side forms a displacement area which alters the amount of fluid which may be placed in the reservoir (in comparison to a second element with no parabolic portion). This displacement area would also effect the amount of air present. Air tends to oxidize wine therefore it should be minimized. Wine has been bottled for years and the amount of air present in the bottling process has been established to maximize flavor and shelf-life.

The fourth element is a cap which is secured to the neck of the third element. The wine is delivered to the bottle (which is formed by the combination of the second and third element) through the aperture in the top of the neck. Once filled, the fourth element is secured thereto. The cap is designed to manufactured from metal or plastic and will seal the bottle to prevent air or fluid from passing either direction.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto. These may include the use of sizes other than single serving wine bottles, use with other bottled alcoholic beverages where it is desirable to have such a convertible bottle, or other non-alcoholic beverages where it is desirable to have such a convertible bottle.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception upon which this disclosure is based may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a single serving wine bottle which may be converted into a wine glass.

It is another object of the invention to provide a wine bottle which may be convertible in to a wine glass.

It is another object of the invention to provide a wine bottle with a central wine reservoir, the wine reservoir including a bottom portion and an intermediate portion, the bottom portion screwed and sealed onto the intermediate portion.

It is another object of the invention to provide a wine bottle wherein the intermediate portion tapers to a neck, the neck designed to receive a cap thereon.

It is another object of the invention wherein the bottom portion includes a depression centrally disposed about a lip, the depression designed to receive the stem of the wineglass therein.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a wine bottle convertible to a wine glass embodying the principles and concepts of the present invention will be described. In the case of a bottle being converted into a glass, it is to be understood that this glass is a drinking glass and may be comprised of material other than glass, such as plastic.

Figure 1:
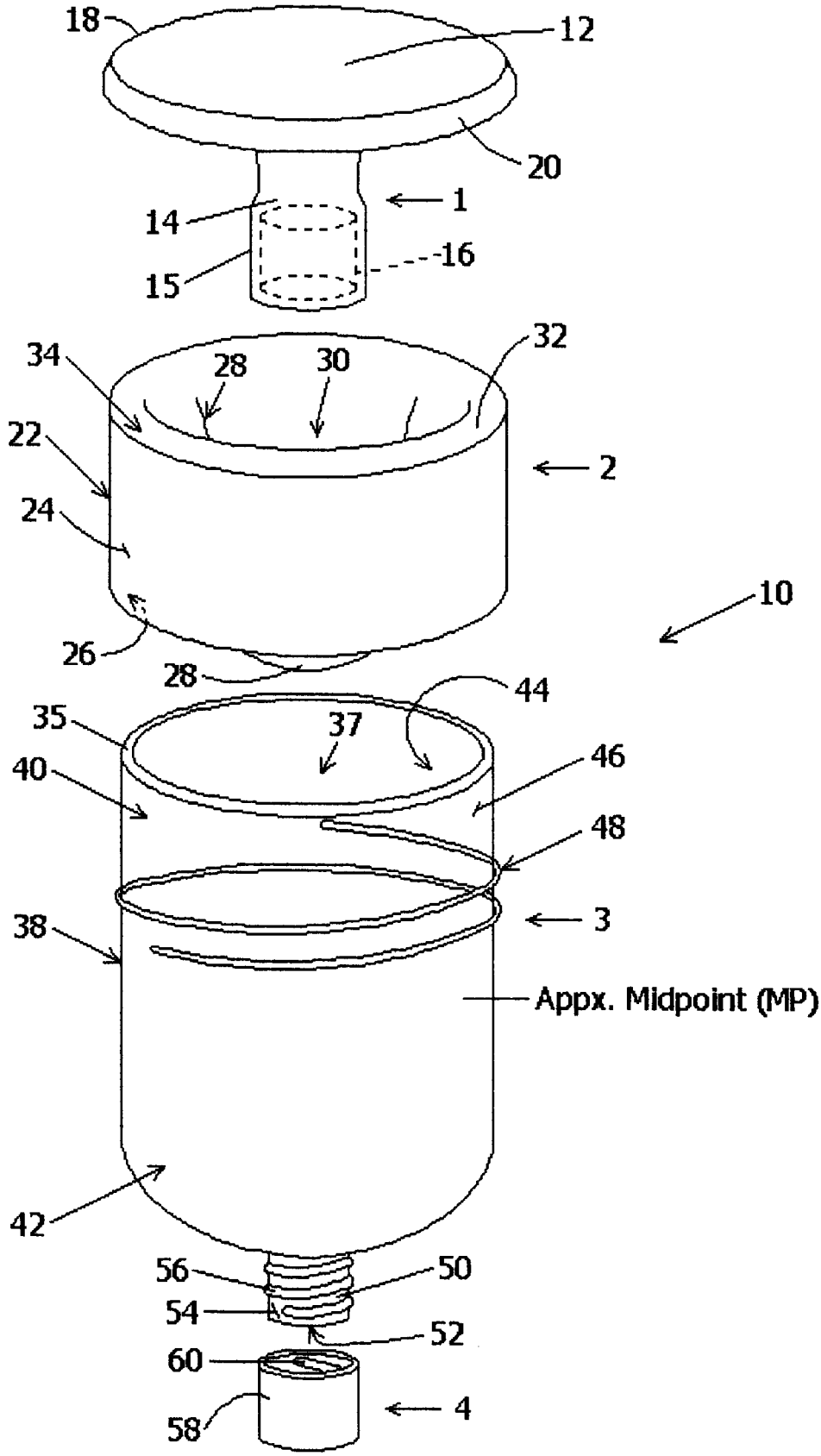
FIG. 1 is a view of the wine bottle and the components forming the same.

Turning initially to FIG. 1, the unassembled wine bottle 10 which is convertible into a wine glass is shown. FIG. 1 shows the components employed. Element 1 shows the base 12 with a centrally disposed stem 14 depending therefrom. The bottom portion 15 of the stem 14 includes a hollow aperture 16 with an interior which may be smooth or threaded. Other means may be incorporated to increase the frictional holding capacity of the hollow aperture. Such means may include mechanisms which would increase the co-efficient of friction. The base 12 has a perimeter 18. A lip portion 20 depends around the perimeter 18 of the base 12.

Figure 10:
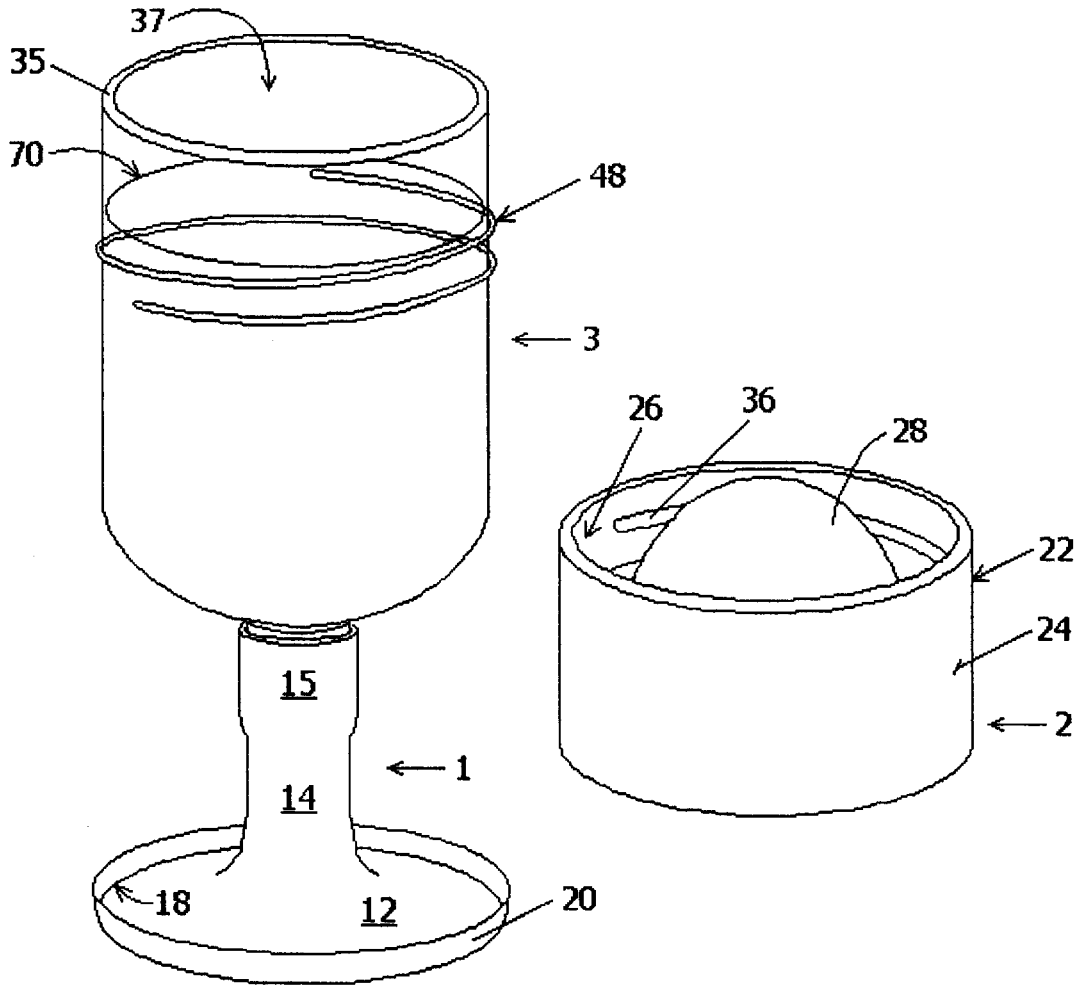
FIG. 10 is a view of the fifth and final step of the wine bottle being converted to a wine glass, showing the wine glass filled with wine ready to be consumed.

Element 2 includes a generally cylindrical sidewall 22 which has an exterior side 24 and an interior side 26. Element 2 includes a centrally disposed parabolic portion 28 or depression which resides in the interior of the cylindrical sidewall 22. It describes a parabolic opening 30 which is surrounded on the top 32 by a ring 34. The parabolic portion 28 is thin and approximates the thickness of the sidewall 22. On the interior side 26 of the cylindrical sidewall 22 is a first set of threads 36. The parabolic portion 28 may also be described as a depression. The depression may assume other shapes other than the parabolic portion 28 which is shown in the figures. The interior area of element 2 is best seen in FIG. 10.

Element 1 fits into element 2. The stem 14 resides in the parabolic opening 30 and the lip portion 20 snap fits about the ring 34 on the top 32 of the second element. Tamper resistant or evident devices may be employed.

Element 3 also has a generally cylindrical sidewall 38 with a top portion 40 and a bottom portion 42. The top of element 3 shows the sidewall 38 forming a circular opening 37. Circular opening 37 is surrounded by lip 35. Lip 35 would mate with the consumers mouth when drinking the wine. Element 3 also includes an interior side 44 and an exterior side 46. A second set of threads 48 are located on the exterior side 46 of the cylindrical sidewall 38 of element 3. The second set of threads 48 are generally located above the midpoint (MP) between the top portion 40 and the bottom portion 42. Below the midpoint (MP) the cylindrical sidewall 38 tapers near the bottom portion 42 to a central neck 50 as shown. Central neck 50 includes an opening 52 to the interior side 44 of element 3. The exterior portion 54 of the central neck 50 includes a third set of threads 56.

Element 2 matingly interengages with element 3. The parabolic portion 28 fits into the circular opening 37 and the first set of threads 36 are mated with and rotated about the second set of threads 48 forming an air and fluid tight seal. Element 3 has a first volume which is reduced proportionally to the amount of the parabolic portion which fits into the interior.

Element 4 is a cap 58. Cap 58 includes a fourth set of threads 60, located on the interior as shown. During the bottling process, once element 2 and element 3 are securely interfit, the bottle or reservoir formed would be filled with wine. At that point cap 58 would be screwed onto element 3 with the third set of threads 56 mating with the fourth set of threads 60 forming an air and fluid tight seal. It is to be noted that once the bottle 10 is filled, cap 58 is sealed.

Figure 2:
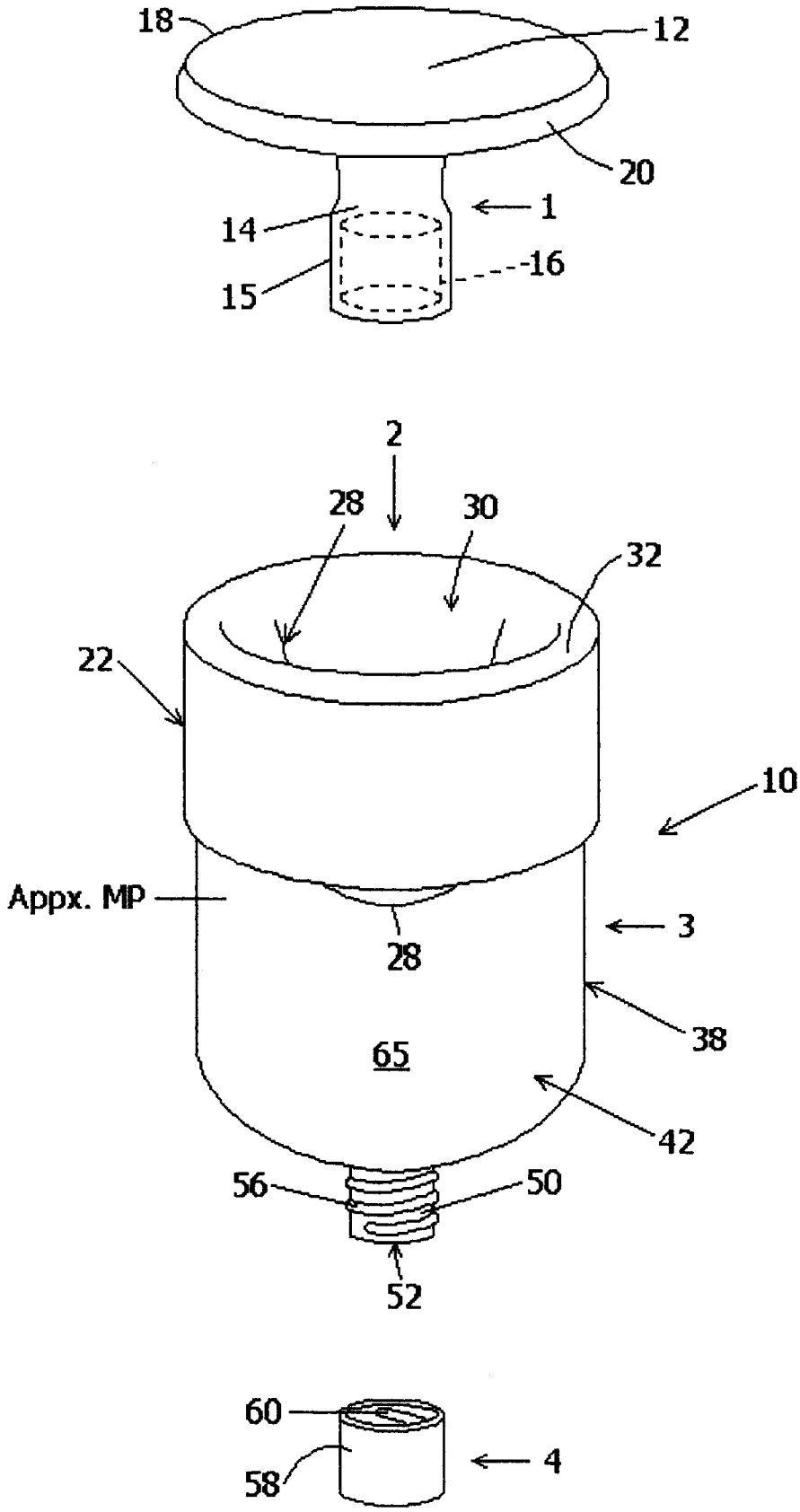
FIG. 2 is a view of the wine bottle showing the connection between the two central elements of the bottle in preparation for bottling.
Figure 11:
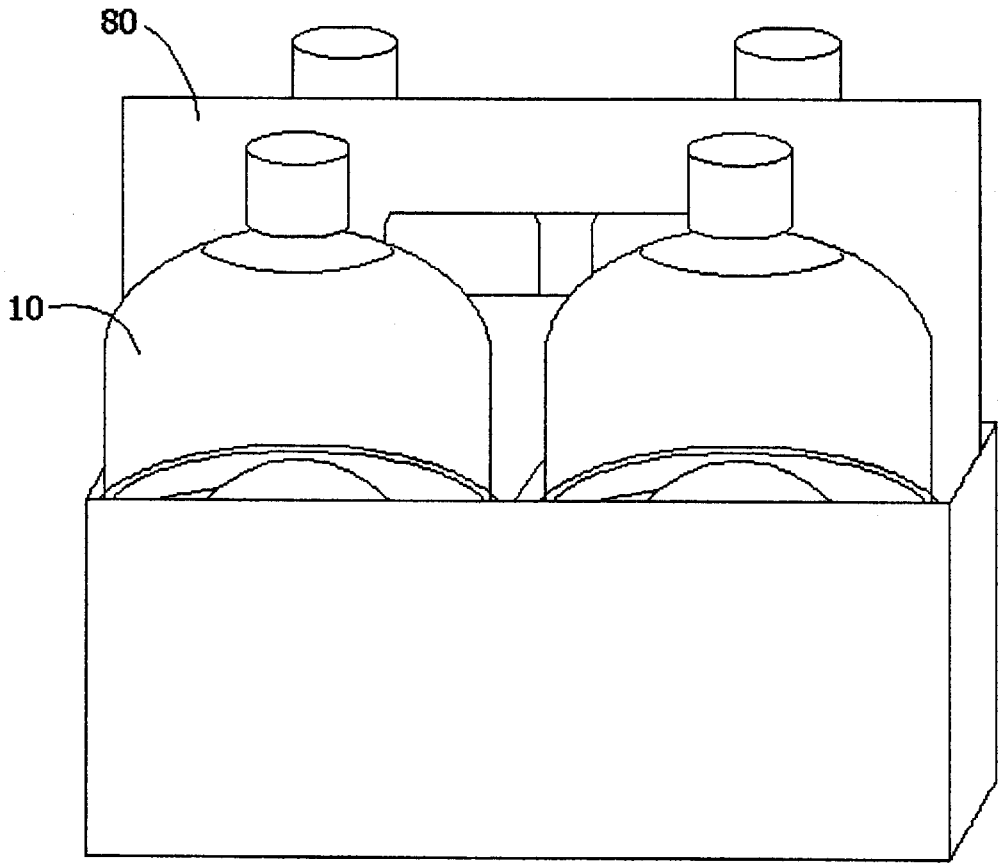
FIG. 11 is a view of a plurality of convertible wine bottles packaged for sale.

FIGS. 1–5 show the construction of the wine bottle 10 at the bottling plant and FIG. 11 shows a possible packaging. FIG. 1 has been discussed above and basically lays out the components and ancillary structure located thereon. Referring now specifically to FIG. 2, the first step in the construction of the bottle 10 is screwing element 2 about element 3. This is done by mating the first set of threads 36 into the second set of threads 48 and turning until sealed. It is to be understood that additional devices or structures may be incorporated into this mating arrangement in order to facilitate an air and fluid tight seal. Once element 2 is affixed securely to element 3, an interior chamber 65 is formed with a single aperture 52.

Figure 3:
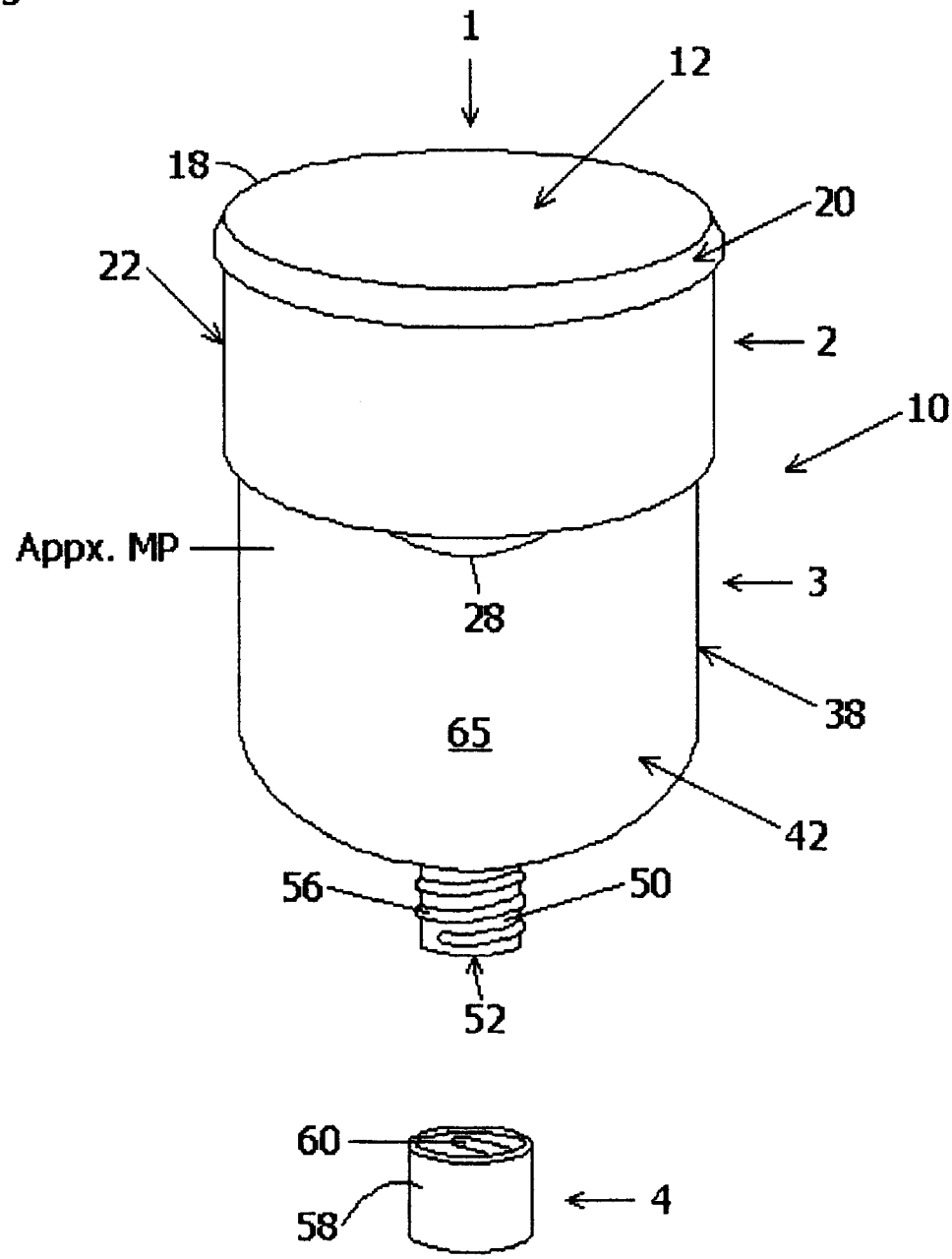
FIG. 3 is a view of the wine bottle showing the connection of a third portion to the central element of the bottle in preparation for bottling.

Referring now specifically to FIG. 3, the next step in the construction of the bottle 10 is placing element 1 into the combination of element 2 and element 3. The stem 14 is received in the parabolic opening 30 and the lip portion 20 snap fits atop top element 32 of element 2.

Figure 4:
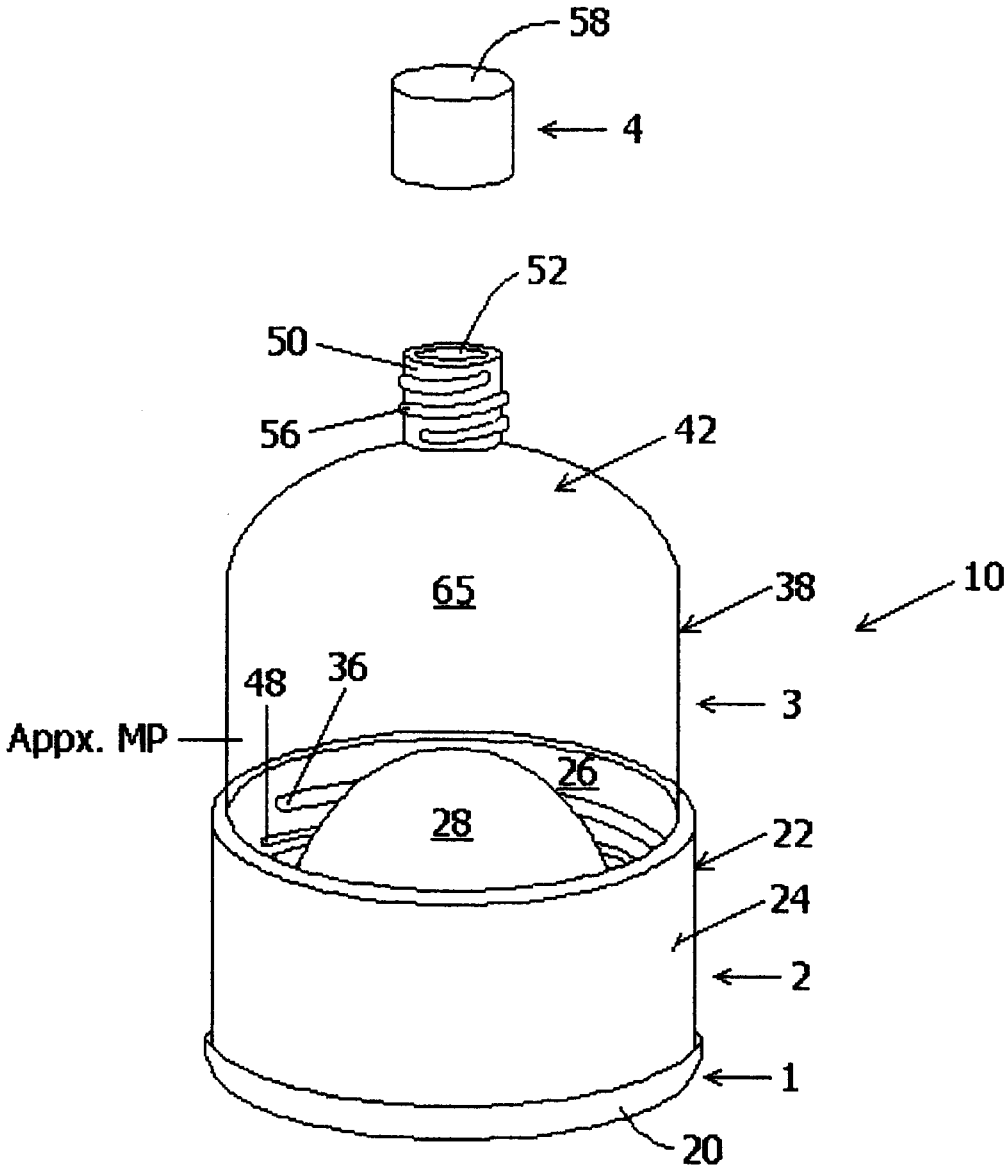
FIG. 4 is a view of the wine bottle just prior to being filled with wine.

Referring now to FIG. 4, the bottle 10 is shown in an orientation which places the cap 58 and the aperture 52 on top. It is at this junction where the interior chamber 65 is filled with wine. Once filled to an appropriate level, certainly above the midpoint (MP), the bottle 10 has the cap 58 placed securely thereon. This is accomplished by mating the third set of threads 56 with the fourth set of threads 60 and screwing the cap on. Again, it is to be understood that additional devices or structures may be incorporated into this mating arrangement in order to facilitate an air and fluid tight seal.

Figure 5:
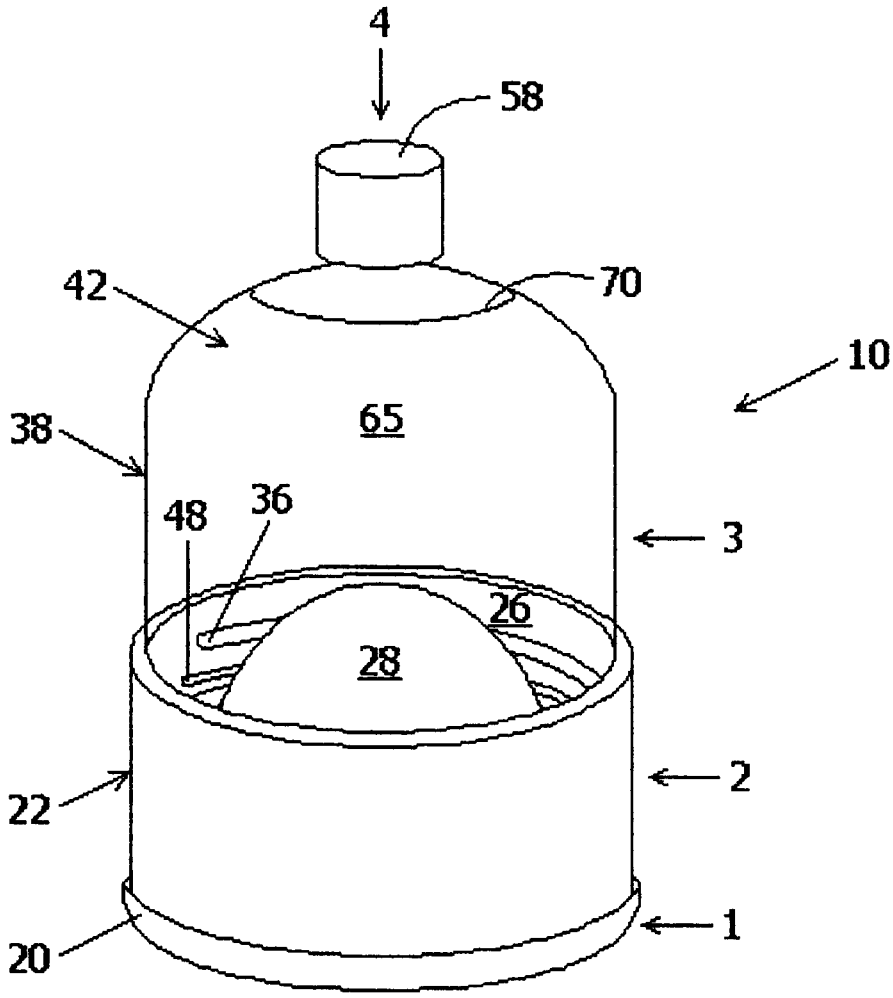
FIG. 5 is a view showing the cap secured to the filled wine bottle.
Figure 6:
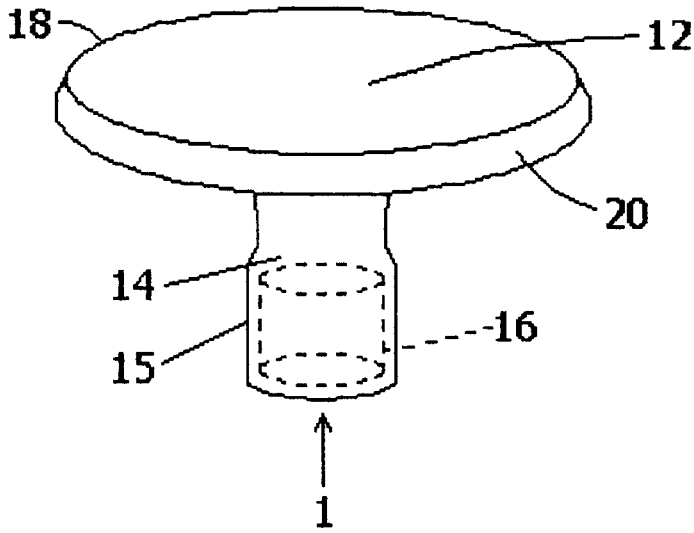
FIG. 6 is a view of the first step of the wine bottle being converted into a wine glass.
Figure 6:
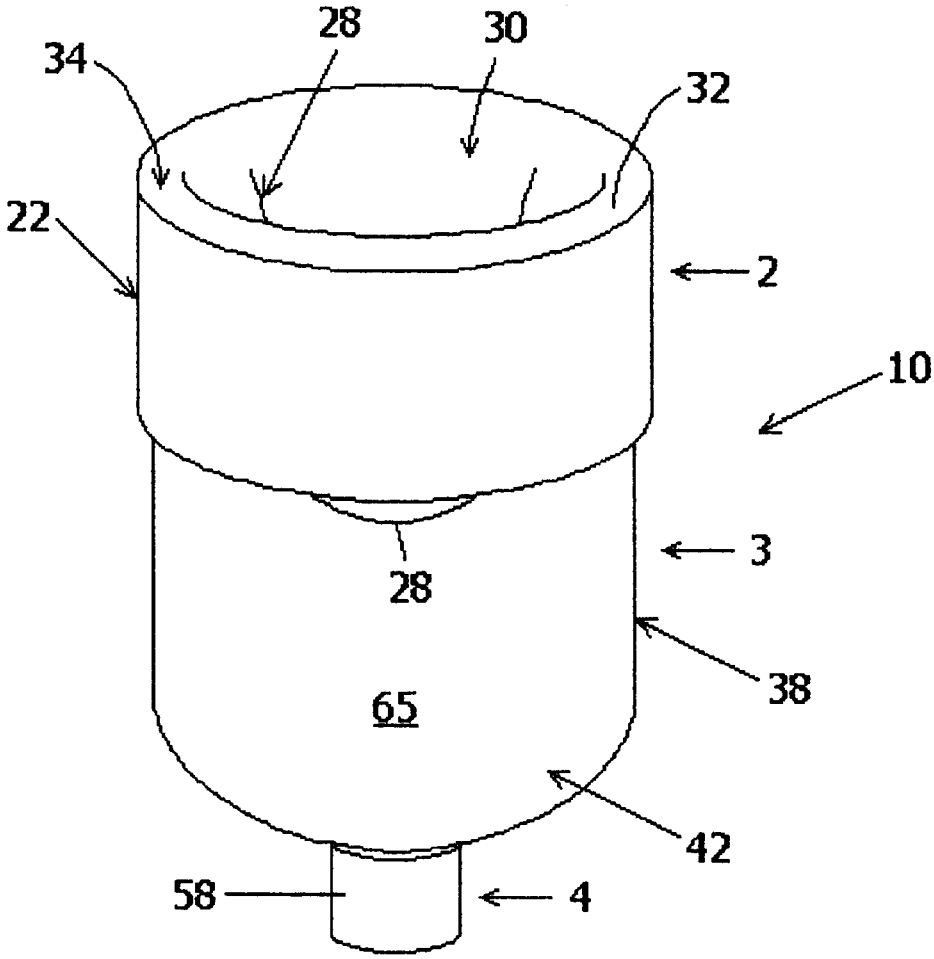

FIG. 5 shows bottle 10 in its completed form. It can clearly be seen the inter-relationship between element 1, element 2, element 3 and element 4. The interior chamber 65 is shown filled with wine to a level indicated at 70. This level 70 in no way indicates the desired level, it is for illustrative purposes only. Although the bottle is basically designed to serve a single wine serving, the serving size may vary with type of wine, with the meal that the wine is served with, cultural factors and manufacturing limitations. One of the main embodiments of the invention would be use of such a single serving convertible wine bottle to wine glass on an airline. Referring now specifically to FIG. 11, a four pack 80 of convertible bottles 10 are shown, ready for sale and consumption.

FIGS. 6–10 will show the conversion of the wine bottle 10 to a wine glass. This conversion will most likely take place by the consumer, although a flight attendant, waitress or waiter, bartender or partner may actually perform the conversion prior to being handed to the consumer. The conversion is easily performed, so that anyone can easily perform the steps. The first step is removing element 1 from element 2. This is done by grasping the base 12 and unsnapping the lip portion 20 from the top portion 32 of element 2.

Figure 7:
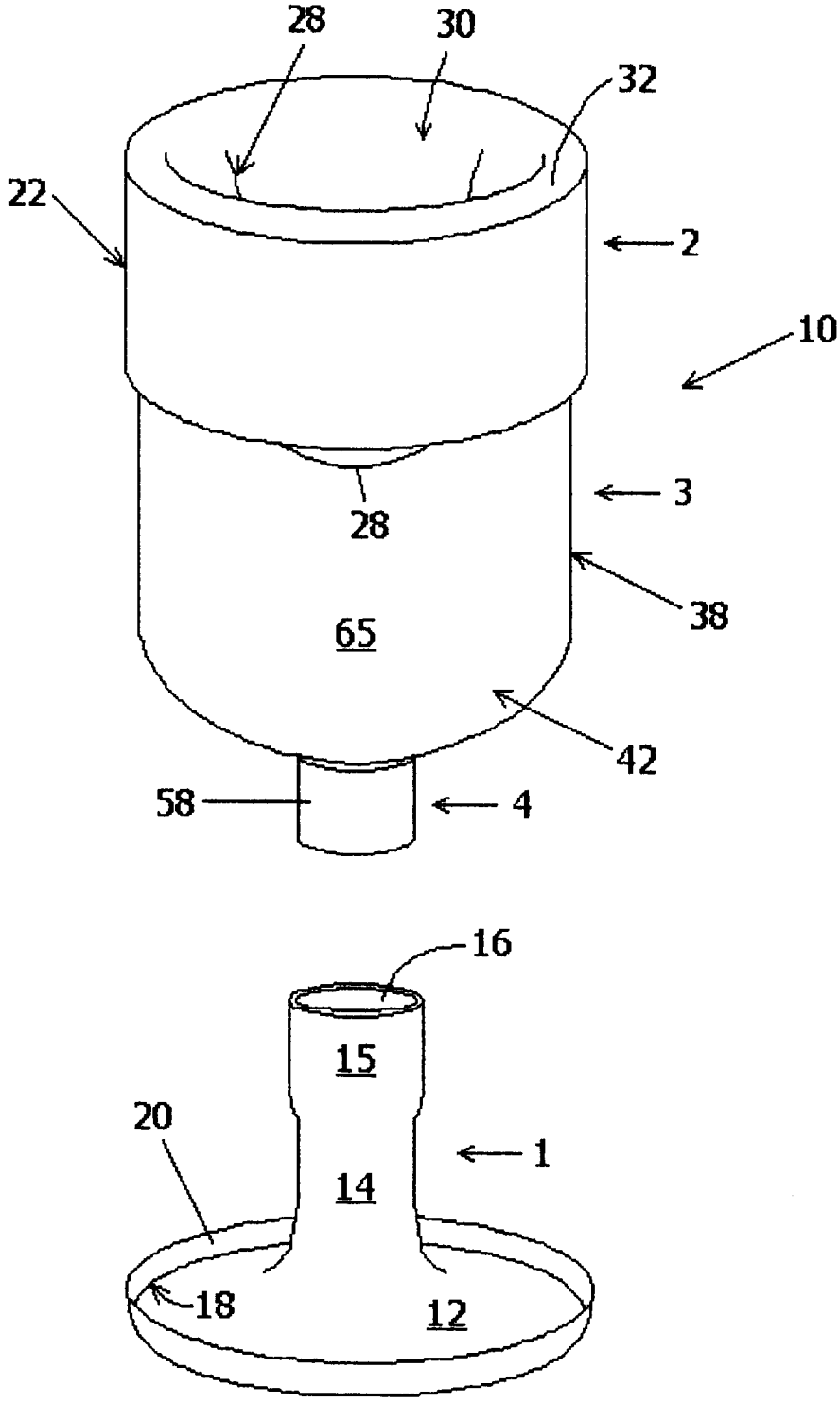
FIG. 7 is a view of the second step of the wine bottle being converted into a wine glass.
Figure 8:
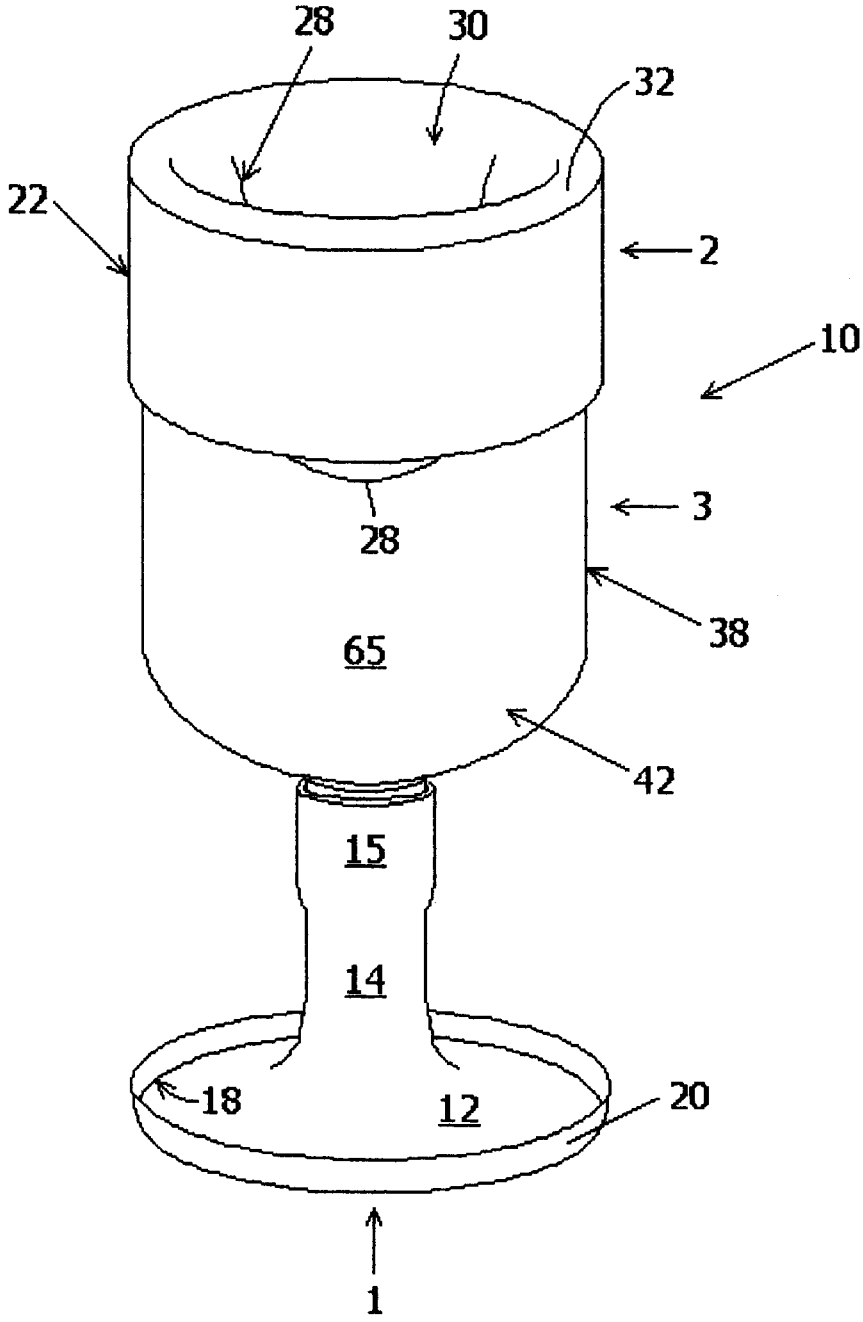
FIG. 8 is a view of the third step of the wine bottle being converted into a wine glass.

The second step is shown in FIG. 7. Hollow aperture 16 is aligned with cap 58. Hollow aperture 16 has been chosen to be sized so that it frictionally fits atop cap 58 in a secure fashion. The hollow aperture 16 may also be known as a recess. It is to be understood that additional devices or structures may be incorporated into this mating arrangement in order to facilitate a tight seal. Such an arrangement may include threads. FIG. 8 shows the stem 14 and base 12 of element 1 mated with element 4. It can be seen that interior chamber 65 with the wine therein is oriented in the proper direction to be consumed.

Figure 9:
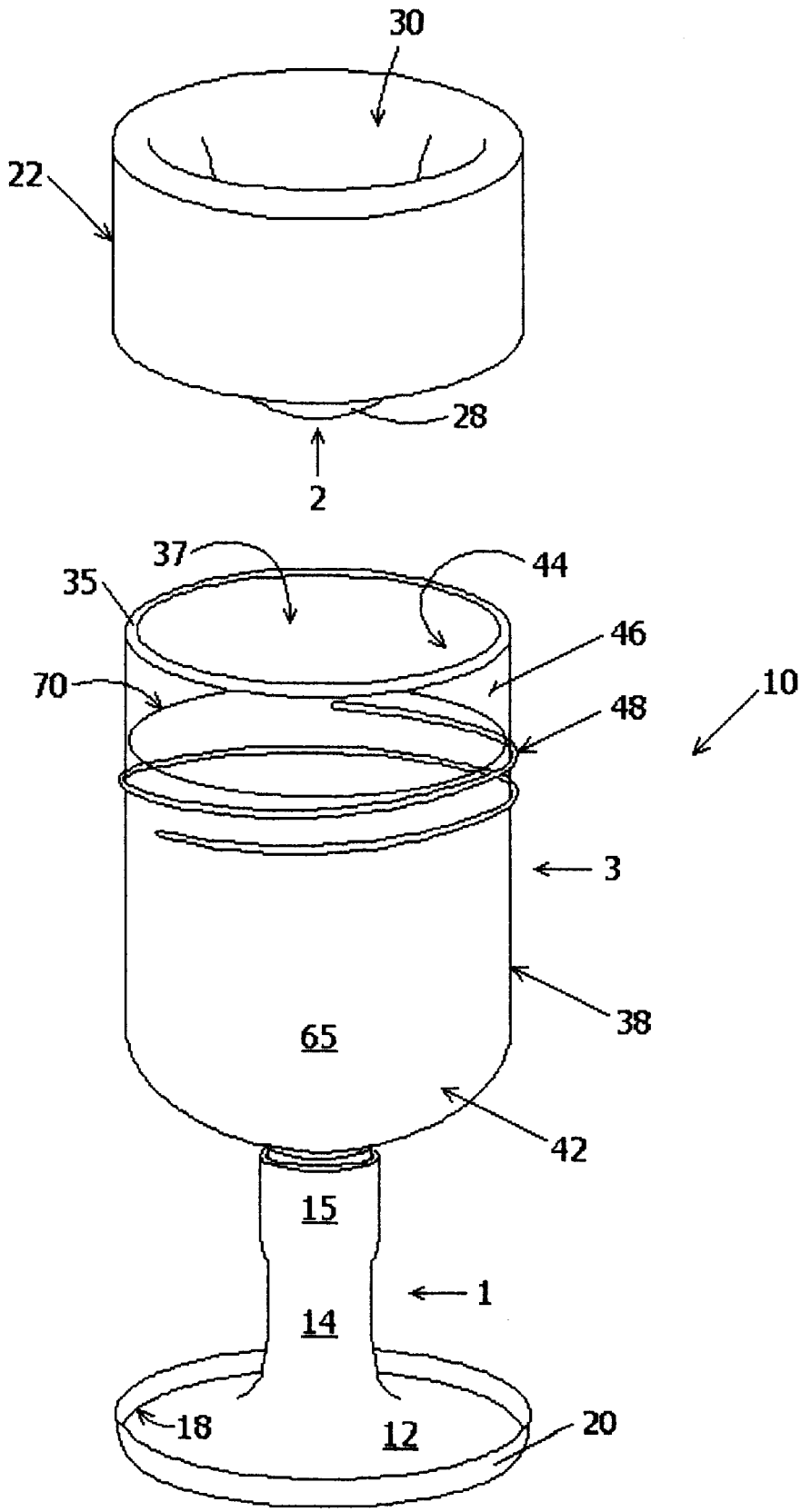
FIG. 9 is a view of the fourth step of the wine bottle being converted into a wine glass.

FIGS. 9 and 10 shows the removal of the element 2 from element 3, essentially opening the wine bottle 10 and leaving the wine bottle converted into a wine glass. The second set of threads 48 remain on the exterior side 46 of the generally cylindrical sidewall 38. This may help the user grasp the glass. In addition, the second set of threads are down low enough on the exterior side 46 of the cylindrical sidewall 38 to prevent one from becoming engaged with it while drinking from the glass.

Again, it is to be understood that wine is just one of the beverages which may be utilized with the instant invention. Wine coolers, other low alcohol content mixed style drinks and other beverages may be employed with the convertible bottle.

It is apparent from the above that the present invention accomplishes all of the objectives set forth by providing a single serving wine bottle which is convertible to a wine glass.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A wine bottle which can be converted into a wine glass comprising:

a) a base, said base including a centrally disposed elongated stem, b) a bottom element, said bottom element having a first sidewall, said first sidewall having an interior side and an exterior side, said bottom element further having a centrally disposed parabolic portion, said first sidewall interior side having a first threaded connection means, c) an intermediate element, said intermediate element having a second sidewall, said second sidewall having an interior side and an exterior side, said second sidewall tapering to a neck, said neck including an aperture, said exterior side having a second threaded connection means, d) a cap, said cap affixed to said neck whereby, said bottom element is connected to said intermediate element by screwing said first threaded connection means onto said second connection means, said bottom element and said intermediate element thereby forming a reservoir, said reservoir filled with wine, whereby when said elongated stem is affixed to said cap, a consumer will be able to hold said elongated stem.

2. A wine bottle which can be converted into a wine glass as claimed in claim 1 wherein said centrally disposed elongated stem is placed in said parabolic portion and said base snap fits atop said bottom portion.

3. A wine bottle which can be converted into a wine glass as claimed in claim 2 wherein said centrally disposed elongated stem includes a hollow recess thereon.

4. A wine bottle which can be converted into a wine glass as claimed in claim 3 wherein said centrally disposed elongated stem may be removed from said parabolic portion and said cap may be matingly engaged with said hollow recess, thus permitting the wine bottle to stand erect upon said base.

5. A wine bottle which can be converted into a wine glass as claimed in claim 4 wherein said bottom portion may be unscrewed from said intermediate portion, thus exposing said reservoir of wine for consumption.

6. A wine bottle which can be converted into a wine glass as claimed in claim 5 wherein said second threaded connection means are located a first distance down on said intermediate element exterior side.

7. A wine bottle which can be converted into a wine glass as claimed in claim 6 wherein said first distance is chosen to be greater than about 1/10th the length of said intermediate element.

8. A wine bottle which can be converted into a wine glass as claimed in claim 1 wherein said cap includes a seal which is both air and wine impermeable.

9. A wine bottle which can be converted into a wine glass as claimed in claim 8 wherein said seal includes plastic.

10. A bottle which can be converted into a glass comprising:

a) a base, said base including a centrally disposed stem, b) a bottom element, said bottom element having a first sidewall, said first sidewall having an interior side and an exterior side, said bottom element further having a centrally disposed depression, said first sidewall interior side having a first threaded connection means, c) an intermediate element, said intermediate element having a second sidewall, said second sidewall having an interior side and an exterior side, said second sidewall tapering to a neck, said neck including an aperture, said exterior side having a second threaded connection means, d) a cap, said cap affixed to said neck whereby, said bottom element is connected to said intermediate element by screwing said first threaded connection means onto said second connection means, said bottom element and said intermediate element thereby forming a sealed reservoir, said reservoir filled with fluid whereby when said stem is affixed to said cap, a consumer will be able to hold said stem while drinking from said glass.

11. A bottle which can be converted into a glass as claimed in claim 10 wherein said centrally disposed stem is placed in said depression and said base is secured atop said bottom portion.

12. A bottle which can be converted into a stemmed glass comprising:

a) a base, said base including a centrally disposed stem, b) a bottom element, said bottom element having a first sidewall, said first sidewall having an interior side and an exterior side, said first sidewall interior side having a first threaded connection means, c) an intermediate element, said intermediate element having a second sidewall, said second sidewall having an interior side and an exterior side, said second sidewall tapering to a neck, said neck including an aperture, said exterior side having a second threaded connection means, d) a cap, said cap affixed to said neck whereby, said bottom element is connected to said intermediate element by screwing said first threaded connection means onto said second connection means, said bottom element and said intermediate element thereby forming a sealed reservoir, said reservoir filled with fluid, whereby when said stem is affixed to said cap, a consumer will be able to hold said stem while drinking from said stemmed glass.

13. A bottle which can be converted into a stemmed glass as claimed in claim 12 wherein said centrally disposed stem interfits about said cap.

14. A bottle which can be converted into a stemmed glass as claimed in claim 12 wherein said bottom element further includes a centrally disposed depression.

15. A bottle which can be converted into a stemmed glass as claimed in claim 14 wherein said centrally disposed stem is placed in said depression and said base is secured about said bottom portion.

16. A bottle which can be converted into a stemmed glass as claimed in claim 12 wherein said fluid is selected from the group consisting of wine, juice, liquor, water, non-alcoholic beverage mixtures and alcoholic beverage mixtures.

* * * * *